United States Patent [19]

Schantz et al.

[11] 4,453,350

[45] Jun. 12, 1984

[54] MARQUEE FOR CONCESSION STAND TRAILERS

[75] Inventors: John S. Schantz; Raymond G. Schantz, both of Marine, Ill.

[73] Assignee: Schantz & Sons, Inc., Marine, Ill.

[21] Appl. No.: 384,969

[22] Filed: Jun. 4, 1982

[51] Int. Cl.[3] ..... E04B 1/346

[52] U.S. Cl. ..... 52/64; 296/21

[58] Field of Search ..... 52/71, 72, 64; 296/21; 135/89

[56] References Cited

U.S. PATENT DOCUMENTS

| | | | |
|---|---|---|---|
| 74,530 | 2/1868 | Harris et al. . | |
| 819,600 | 5/1906 | Rodjeff . | |
| 926,186 | 6/1909 | Heales . | |
| 1,526,527 | 2/1925 | Butler | 52/64 |
| 1,715,853 | 6/1929 | Madsen | 52/64 |
| 2,552,112 | 5/1951 | Pierce . | |
| 3,160,435 | 12/1964 | Smith | 52/64 X |
| 3,890,747 | 6/1975 | Van der Lely | 52/64 |
| 4,019,773 | 4/1977 | Vehling | 296/21 |

*Primary Examiner*—Carl D. Friedman

*Attorney, Agent, or Firm*—Glenn K. Robbins

[57] ABSTRACT

A simply erected marquee for vending stands which in a collapsed position presents a streamlined appearance to lessen wind resistance in transport. The marquee when erected has upwardly and outwardly extending walls to present an overhang appearance. When collapsed the side and end walls slope outwardly and downwardly to present a streamlined appearance. The marquee is hingedly connected to an upstanding lower marquee support set inwardly of the edges of the roof of the vending stand such that when the marquee is collapsed the marquee rests on the edge of the roof to define a protective space between it and the marquee support.

8 Claims, 4 Drawing Figures

MARQUEE FOR CONCESSION STAND TRAILERS

BACKGROUND OF THE INVENTION

In the past various types of vending stands have been provided for transportation from one area to another. Such vending stands or concession stands are typified in U.S. Pat. Nos. 2,896,706 and 3,356,126. Such stands may be trailer mounted for ready transportation and for convenience and ready use must be easily and quickly set up for use and after such use be made ready for travel with dispatch.

Such vending stands are employed wherever people congregate to vend hot dogs, soft drinks, ice cream and the like. The advertising of the goods serves a valuable service in attracting customers and signs of one type or another have been employed. Vertical upstanding marquees rising above the roof of the vending stand have been employed but have the disadvantage of presenting considerable wind resistance when the vending stand is transported upon the highway as upon a trailer or the like.

SUMMARY OF THE INVENTION

By means of this invention there has been provided a vending stand with an upstanding marquee which extends upwardly and outwardly to provide great visibility and may be simply and easily collapsed to provide a downwardly and outwardly sloping presentation to greatly lessen wind resistance when the stand is transported on the highway from one location to another.

The marquee because of its downward and outward slope further provides a protective space for a lower marquee support section when it is collapsed. The lower support section may itself be provided with a sign and electric illumination means which are safeguarded when the marquee is collapsed.

The erection and collapsing of the marquee is provided by a hinged connection from the lower marquee support section which is set inwardly from the outer edge of the roof of the vending stand. By this construction the marquee wall sections when erected provide an overhang structure and when collapsed the outer edges may be supported upon the edge of the roof and serve as a streamline to lessen wind resistance and protect any sign structure on the lower marquee support.

The marquee structure of this invention is rugged and simply constructed. The erection and collapsing are simply effected without the requirement of complex mechanism or tools and are simply carried out without the requirement of special techniques or experience by the average user.

The above features are objects of this invention. Further objects will appear in the detailed description which follows and will be otherwise apparent to those skilled in the art.

For the purpose of illustration of this invention a preferred embodiment is shown and described hereinbelow in the accompanying drawing. It is to be understood that this is for the purpose of example only and that the invention is not limited thereto;

IN THE DRAWING

DESCRIPTION OF THE INVENTION

Figure 1:
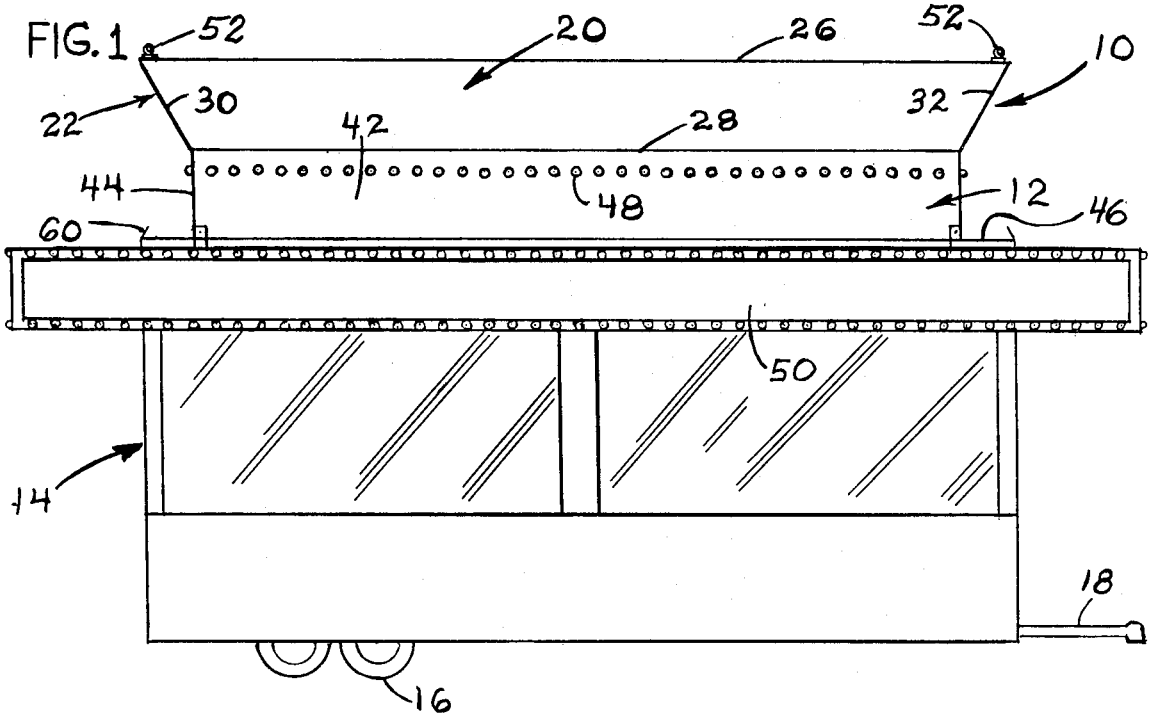
FIG. 1 is a view in side elevation of the concession stand trailer with the marquee in erected position.
Figure 2:
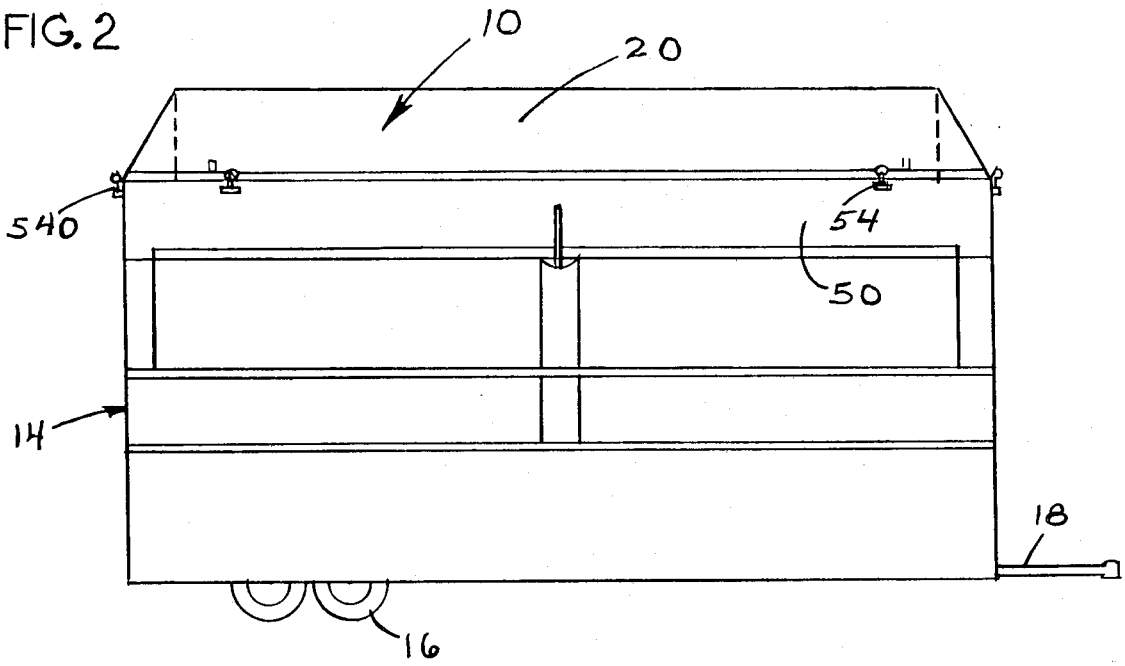
FIG. 2 is a view taken similarly to FIG. 1 showing the marquee in collapsed position for traveling.

The marquee of this invention is generally designated by the reference numeral 10. It is shown in FIGS. 1 and 2 hingedly connected to a lower marquee support 12 which is supported from a concession type vending stand 14. The vending stand is of the trailer form having wheels 16 and a trailer tongue 18 for connection to a tow vehicle.

The marquee 10 is comprised of a pair of side walls 20 and a pair of end walls 22 which are hingedly connected to the top of the lower marquee support 12 by hinges 24. The side walls 20 are constructed similarly and are of a trapezoidal shape having parallel top and bottom edges 26 and 28 and slanting side edges 30 and 32. The end walls 22 are of similar trapezoidal configuration, albeit not as long, and have top and bottom parallel edges 34 and 36 and slanting side edges 38 and 40.

Figure 3:
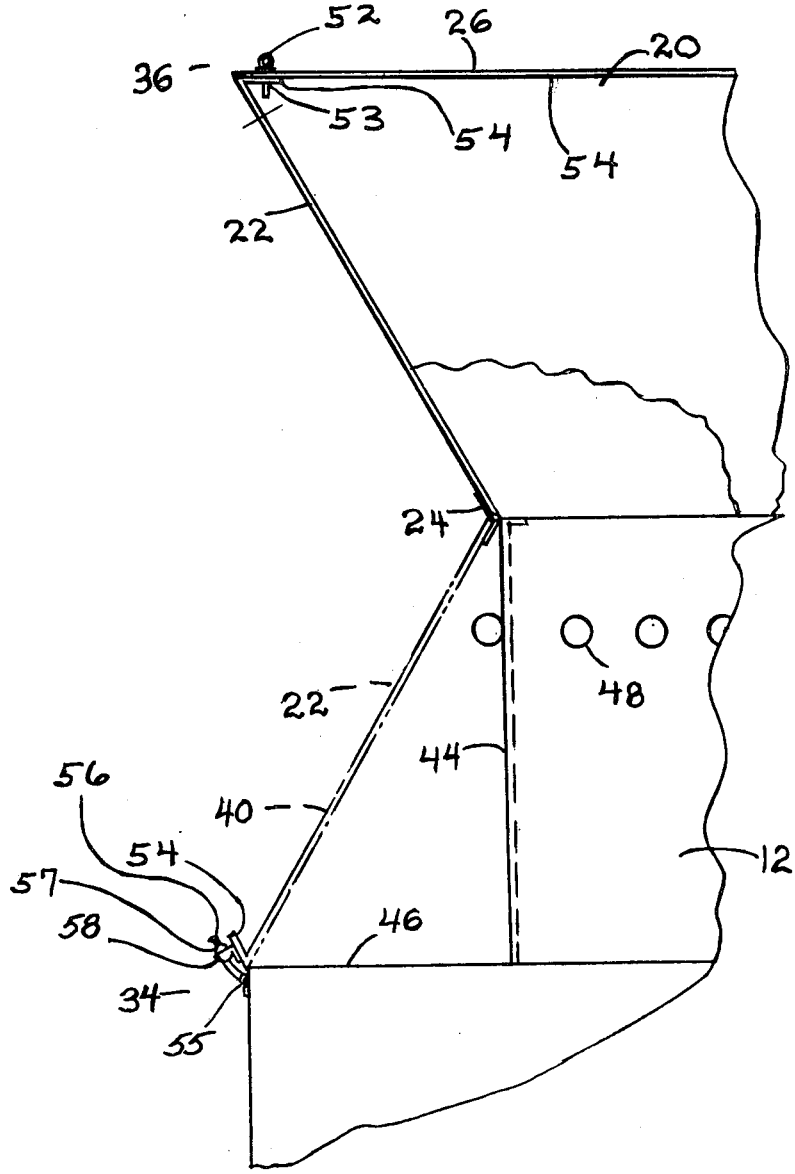
FIG. 3 is an enlarged fragmentary view in side elevation partly broken away showing the hinge and securing structure at the corner of the marquee.

The lower marquee support 12 is rectangular in shape and is formed from upstanding rectangular side walls 42 and end walls 44 as best shown in FIGS. 1 and 3. The walls are supported upon a roof 46 of the vending stand 14 inwardly of the sides of the vending stand. A series of electric lights 48 are supported on the walls of the lower marquee support to provide illumination and it will be understood that various types of advertising indicia may be placed on the wall surfaces of the lower marquee support and also upon the wall surfaces of the marquee side and end walls.

The vending stand is further provided with an awning or canopy 50 which is shown in the erected form in FIG. 1 and the collapsed position for traveling or storage in FIG. 2. This may likewise be provided with lights and advertising as desired.

Figure 4:
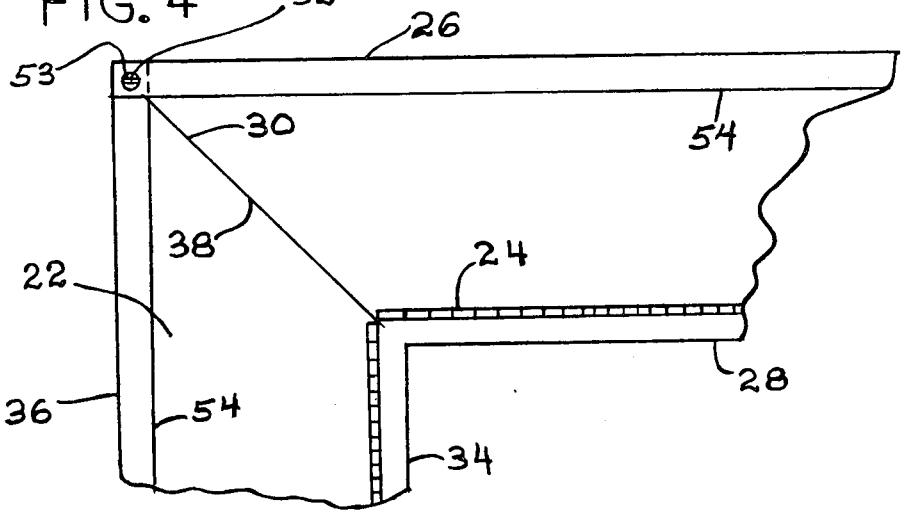
FIG. 4 is an enlarged fragmentary plan view of the corner of the marquee in the erected position.

The support means for the marquee side and end walls is best shown in FIGS. 3 and 4. By virtue of the support hinge 24 connected to the top of the lower marquee support the side and end walls may be easily moved from the erected position shown in full lines in FIG. 3 to the collapsed position shown in dotted lines.

In the erected position the side and end walls of the marquee are secured by a pin 52 fitting through registering holes 53 in the ends of turned in reinforcing flanges 54 at the edges of the walls as best shown in FIG. 4. The ends of the flanges overlap one another in the erected position. The pin may be connected to a wall by a securing chain to prevent loss. The securing means employed is of illustrative purposes and it will be understood that other securing devices may be employed as desired.

In the collapsed position the side and end walls of the marquee after removal of the securing means are lowered to the dotted line position shown in FIG. 3. In this position the top edges 26 of the side walls rest on the edge of the roof of the vending stand as do also the edges 36 of the end walls. In the rest or collapsed position secure engagement may be effected by a rubber keeper 540 pivotally connected by a bracket 55 to the sides of the awning 50 as shown in the dotted line position of FIG. 3. The keeper has a finger grip 56 and a ball portion 57 engageable in a notched bracket 58 supported on the flanges 54 of the side and end walls of the marquee. As in the case of the securing of the side and end walls of the marquee in the erected position it will be understood that this securing is exemplary only and that other types of securing means may be employed as desired.

By virtue of the trapezoidal configuration of the side and end walls which have the same angle slope at the end edges the adjacent side and end wall merge to form a mating corner. While the angle of slope is shown at 60° it will be understood that this may be varied as desired between 0 and 90° . The spacing of the lower marquee support inside the outer edge of the roof and the certical height of the lower marquee support can likewise be varied to determine the angle of slope as will be well understood.

The use of the collapsible streamlined marquee is very simply effected. To erect the stand the side and end walls are elevated to the erected position by simply raising the walls individually to the position shown in FIGS. 1 and 3. This is accomplished by the hinging connection. When so elevated the retainer pin 52 which is inserted through the registering holes 53 at the overlapped ends of the flanges 54. When all four walls are elevated they mate and are connected at the corners to form the upwardly and outwardly overhanging marquee.

To collapse the marquee for storage or traveling the awning 50 is collapsed. The marquee is then collapsed by removing the pins 52. The side and end walls are then moved to a rest position on top of the roof 46. The keeper is then connected to the side and end walls by inserting the ball portion in the notched bracket 58. The vending stand after collapse of the marquee and awning or canopy is then ready for travel or storage.

Various changes and modifications may be made within this invention as will be apparent to those skilled in the art. Such changes and modifications are within the scope and teaching of this invention as defined by the claims appended hereto.

What is claimed is:

1. A marquee for a vending trailer or the like, said trailer having a roof top supporting said marquee, said marquee comprising a pair of side walls hingedly connected to a support on said roof top and a pair of end walls hingedly connected to a support on said roof top, said side and end walls being moveable from an erected position where opposite ends of said walls are engageable in a first mating relation to a collapsed position where said opposite ends are engageable in a second mating relation, said side and end walls in the erected position extending upwardly and outwardly with respect to said roof top and in the collapsed position extending downwardly and outwardly with respect to said rood top.

2. The marquee of claim 1 in which the ends of said side and end walls extend from a longitudinal axis of said walls at an angle between 0 and 90° to provide an upward and outer slope of said walls when said ends are mated in the erection position.

3. The marquee of claim 2 in which said end and side walls have a trapezoidal shape.

4. The marquee of claim 1 in which securing means are provided for securing adjacent side and end walls at the corner of said marquee.

5. The marquee of claim 1 in which said marquee has a lower marquee support extending upwardly in spaced relation from edges of said roof and inwardly thereof, said lower marquee support being supported from said roof and comprising said aforementioned support on said roof top.

6. The marquee of claim 5 in which said end and side walls are hingedly connected to an upper portion of said marquee support and extend upwardly and outwardly therefrom in the erected position, said end and side walls in the collapsed position extending downwardly and outwardly from said marquee support and resting in spaced relation from a bottom portion of said marquee support on an outer portion of said roof top to provide a protected space between said side and end walls and said marquee support.

7. The marquee of claim 6 in which the ends of said side and end walls extend from a longitudinal axis of said walls at an angle between 0 and 90° to provide an upward and outer slope of said walls when said ends are mated in the erected position.

8. The marquee of claim 6 in which said end and side walls have a trapezoidal shape.

* * * * *